US011686017B2

(12) United States Patent
Tonosaki et al.

(10) Patent No.: US 11,686,017 B2
(45) Date of Patent: Jun. 27, 2023

(54) LIQUID CRYSTALLINE POLYESTER FIBER AND METHOD FOR PRODUCING THE SAME

(71) Applicant: KURARAY CO., LTD., Kurashiki (JP)

(72) Inventors: Hiroki Tonosaki, Osaka (JP); Takashi Katayama, Chiyoda-ku (JP); Junya Ide, Kurashiki (JP); Keiichi Ikehata, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 560 days.

(21) Appl. No.: 16/623,057

(22) PCT Filed: Jul. 20, 2018

(86) PCT No.: PCT/JP2018/027401
§ 371 (c)(1),
(2) Date: Dec. 16, 2019

(87) PCT Pub. No.: WO2019/021978
PCT Pub. Date: Jan. 31, 2019

(65) Prior Publication Data

US 2020/0165748 A1 May 28, 2020

(30) Foreign Application Priority Data

Jul. 24, 2017 (JP) ..... JP2017-142376

(51) Int. Cl.
*D01F 6/62* (2006.01)
*B08B 3/12* (2006.01)
*D06M 11/13* (2006.01)

(52) U.S. Cl.
CPC ..... *D01F 6/62* (2013.01); *B08B 3/12* (2013.01); *D06M 11/13* (2013.01)

(58) Field of Classification Search
None
See application file for complete search history.

(56) References Cited

U.S. PATENT DOCUMENTS

| | | | |
|---|---|---|---|
| 4,668,454 | A | 5/1987 | Dickerson, Jr. et al. |
| 4,865,790 | A | 9/1989 | Sugimoto et al. |

FOREIGN PATENT DOCUMENTS

| | | | | |
|---|---|---|---|---|
| CN | 102443873 | | * | 5/2012 |
| CN | 104024495 | | * | 9/2014 |
| EP | 2 692 913 | A1 | | 2/2014 |
| JP | 61-231217 | A | | 10/1986 |
| JP | 61-231218 | A | | 10/1986 |
| JP | 61 -2891 78 | A | | 12/1986 |
| JP | 62-45726 | A | | 2/1987 |
| JP | 62-45743 | A | | 2/1987 |
| JP | 63-099328 | A | | 4/1988 |
| JP | 20090115227 | | * | 11/2009 |
| JP | 2016-89308 | A | | 5/2016 |
| WO | WO 83/02424 | A1 | | 7/1983 |

OTHER PUBLICATIONS

Machine translation of JPS6399328 (Year: 1988).*
Machine Translation OFKR20090115227 (Year: 2009).*
Machine translation of CN102443873 (Year: 2012).*
Machine translation of CN 104024495 (Year: 2014).*
Extended European Search Report dated May 13, 2020 in Patent Application No. 18838083.6, citing documents AO-AQ therein, 7 pages.
International Search Report dated Aug. 21, 2018 in PCT/JP2018/027401 filed on Jul. 20, 2018, citing references AA-AB and AP-AS therein, 1 page.
European Office Action dated Jan. 27, 2021 in European Patent Application No. 18 838 083.6, 5 pages.

* cited by examiner

*Primary Examiner* — Shawn Mckinnon
(74) *Attorney, Agent, or Firm* — Oblon, McClelland, Maier & Neustadt, L.L.P.

(57) ABSTRACT

A liquid-crystal polyether fiber with high tensile strength has an ash content of 0.3 percent by weight or less, a degree of fusion (f) of 3 or less, and a tensile strength of 18 cN/dtex or more. The liquid-crystal polyether fiber has few residues of an anti-fusion agent and causes no fusion between filaments.

10 Claims, No Drawings

LIQUID CRYSTALLINE POLYESTER FIBER AND METHOD FOR PRODUCING THE SAME

TECHNICAL FIELD

The present invention relates to liquid crystalline polyester fibers and a method for manufacturing such liquid crystalline polyester fibers.

BACKGROUND ART

Liquid crystalline polyesters can form a highly oriented fiber obtained only through melt spinning and can exhibit physical properties of a high level. Additionally, the strength and modulus of elasticity of the fiber can be further improved by applying heat treatment at around the softening temperature. However, heat treatment allows single filaments to fuse easily. When there is fusion, the fiber develops a tensile strength in the axial direction since part of the stress in the axial direction of the fiber is converted toward the direction perpendicular to the fiber axis. However, the cohesion of molecules is weak in the direction perpendicular to the fiber axis, which makes the fiber extremely fragile. This increases the effects of certain defects unique to aromatic polyester fibers, resulting in deterioration of the mechanical properties of the fibers.

To address this problem, the prior art has proposed methods for preventing single fibers from fusing during heat treatment such as a method of attaching inorganic particles before heat treatment (see, for example, Patent Document 1) and a method of applying heat treatment in a heating medium of organic liquids such as silicone oil (see, for example, Patent Document 2).

CITATION LIST

Patent Documents

[Patent Document 1] Japanese Unexamined Patent Publication No. S62-45726

[Patent Document 2] Japanese Unexamined Patent Publication No. S61-231217

SUMMARY OF THE INVENTION

Technical Problem

However, with the method described in Patent Document 1, it is difficult to wash away the inorganic particles that were attached for the purpose of preventing fusion without damaging the fibers after heat treatment. As a result, a large quantity of inorganic particles remains on the surface of the fiber. Thus, during manufacturing steps after the heat treatment, the fibers to which the inorganic particles are attached rub against each other or against the rollers and guides used in the manufacturing step, causing damage to the surface. This damage causes problems such as defects of, e.g., single-yarn breakage (defined below) and fibrillation, and deterioration of the mechanical properties of the fibers.

The method where heat treatment was applied to a heating medium of organic liquids such as silicone oil as described in Patent Document 2 does not pose the problem of decreasing the fiber strength due to inorganic particles. However, it is difficult to remove the heating medium attached to the surface of the fiber. Furthermore, when the heating medium is removed by washing, it is necessary to use an organic solvent, which is not preferable from the point of view of operator safety and environmental risk.

Solution to the Problem

Therefore, through intensive study of the above-mentioned problems, the present inventors have found that a spun yarn to which water-soluble salts such as potassium iodide and sodium chloride are attached as an anti-fusion agent is heated, and then, the water-soluble salts are washed off, thereby obtaining a liquid crystalline polyester fiber with high tensile strength that has few residues of the anti-fusion agent and causes no inter-fiber fusion to develop the present invention.

In order to achieve the above object, the liquid crystalline polyester fiber of the present invention has an ash content of 0.3 percent by weight or less, a degree of fusion (f) of 3 or less, and a tensile strength of 18 cN/dtex or more.

The method for manufacturing the liquid crystalline polyester fiber of the present invention includes at least attaching water-soluble salts to a raw spun yarn of the liquid crystalline polyester fiber before performing a heat treatment.

Advantages of the Invention

According to the present invention, it is possible to provide a liquid crystalline polyester fiber with high tensile strength that has few residues of the anti-fusion agent on the fiber surface and causes no inter-fiber fusion.

DESCRIPTION OF EMBODIMENTS

According to the present invention, water-soluble salts are attached to a raw spun yarn of a liquid crystalline polyester fiber and heat treatment is applied to the fiber to obtain a liquid crystalline polyester fiber with high tensile strength that prevents fusion between single fibers.

The details of the present invention will be described below.

It is important that the liquid crystalline polyester fiber of the present invention has a high tensile strength. "High tensile strength" of fiber of the present invention means that the tensile strength thereof is 18 cN/dtex or more. The tensile strength of the fiber of the present invention is preferably 20 cN/dtex or more, and more preferably 23 cN/dtex or more. The tensile strength is calculated through the measuring method described in the examples below.

Also, it is important that the degree of fusion (f) of the liquid crystalline polyester fiber of the present invention is 3 or less. The degree of fusion (f) is more preferably 2 or less and still more preferably 1.5 or less. If the degree of fusion (f) is greater than 3, the defects and the number of fibrils (defined below) increase in the obtained fiber, resulting in deterioration of the quality of the production, deterioration of the processability in higher-order processing steps, and a decrease in fiber strength due to the defects and the fibrils. This degree of fusion (f) is calculated through the measuring method described in the examples below.

Furthermore, it is important that the liquid crystalline polyester fiber of the present invention has an ash content of 0.3 percent by weight or less. When the ash content is greater than 0.3 percent by weight, the fiber is more easily damaged due to the large quantity of the anti-fusion agent attached to the fiber surface, which decreases the fiber strength and deteriorates the process passage capability.

In other words, the liquid crystalline polyester fiber of the present invention has an ash content of 0.3 percent by weight or less; and, since the residual amount of the anti-fusion agent on the surface of the fiber is low, it is possible to reduce the inconvenience caused by the residual anti-fusion agent (inconvenience such as the decreases in fiber strength or process passage capability due to defects such as single-yarn breakage or fibrils)).

Since a large quantity of the anti-fusion agent is left on the fiber surface, defects such as single-yarn breakage and fibrillation are likely to occur during the process. Therefore, it is preferable to use a water-soluble salt as the anti-fusion agent in the present invention. The water-soluble salt is attached to the fiber of the present invention, and then, this fiber is heated, thereby washing off the water-soluble salt. As a result, the ash content of the fibers of the present invention can be reduced. This ash content is preferably 0.2 percent by weight or less, more preferably 0.1 percent by weight or less. The ash content is calculated through the measuring method described in the examples described below.

The water-soluble salt used in the present invention does not have any limitations as long as it is a solid that is soluble in a polar solvent such as water and does not melt at the heat treatment temperature. Example of alkali metal salts include lithium chloride, sodium chloride, potassium chloride, lithium bromide, sodium bromide, potassium bromide, lithium iodide, sodium iodide, potassium iodide, lithium carbonate, sodium carbonate, potassium carbonate, lithium sulfate, sodium sulfate, and potassium sulfate. Among these, it is more preferable to use alkali metal halide salts such as lithium chloride, sodium chloride, potassium chloride, lithium bromide, sodium bromide, potassium bromide, lithium iodide, sodium iodide or potassium iodide. Furthermore, after the heat treatment, the salt can be easily washed off because of high solubility in water. The use of sodium iodide, potassium iodide, sodium chloride and potassium chloride is especially preferred since they are relatively inexpensive. These water-soluble salts may be used either alone, or in combination with two or more salts.

The liquid crystalline polyester fiber of the present invention can be obtained by melt-spinning of a liquid crystalline polyester. The liquid crystalline polyester contains a repeating structural units derived from, for example, an aromatic diol, an aromatic dicarboxylic acid, or an aromatic hydroxycarboxylic acid. The chemical structure of the repeating structural units derived from an aromatic diol, an aromatic dicarboxylic acid, or an aromatic hydroxycarboxylic acid does not have any particular limitations as long as it does not impede the effects of the present invention. The liquid crystalline polyester may also contain a structural unit derived from an aromatic diamine, an aromatic hydroxyamine or an aromatic aminocarboxylic acid within a range that does not impede the effects of the present invention. Examples of preferred structural units are provided in Table 1.

TABLE 1

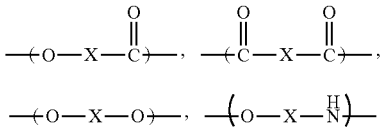

(X in the formula is selected from the structure below.)

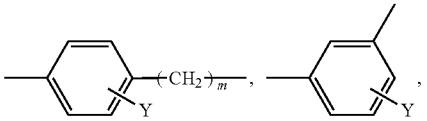

TABLE 1-continued

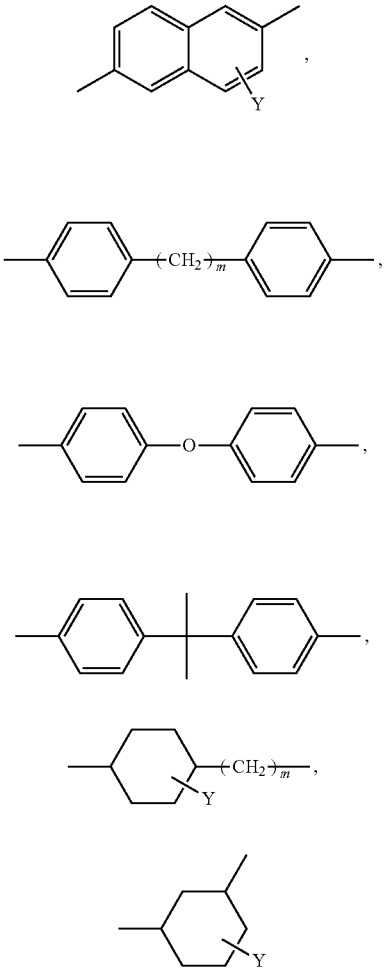

(M is equal to 0 to 2, and Y is a substituent selected from a hydrogen atom, a halogen atom, an alkyl group, an aryl group, an aralkyl group, an alkoxy group, an aryloxy group and an aralkyloxy group.)

Regarding the structural units in Table 1, m is an integer from 0 to 2, and Y in the formula may be, independently, a hydrogen atom, a halogen atom (for example, a fluorine atom, a chlorine atom, a bromine atom or an iodine atom), an alkyl group (for example, alkyl groups having carbon atomic numbers 1 to 4 such as a methyl group, an ethyl group, an isopropyl group, or a t-butyl group), an alkoxy group (for example, a methoxy group, an ethoxy group, an isopropoxy group or a n-butoxy group) an aryl group (for example, a phenyl group, and a naphthyl group), an aralkyl group (for example, a benzyl group (a phenylmethyl group) or a phenethyl group (a phenylethyl group)), an aryloxy group (for example, a phenoxyl group), or an aralkyloxy group (for example, a benzyloxy group) within a range from one until the maximum number that is substitutable.

Examples of more preferable structural units are described in examples (1) to (18) that are shown in Table 2, Table 3, and Table 4. When the structural unit in the formula is one that is capable of exhibiting a plurality of structures, two types or more of such structural units may be combined as a structural unit constituting a polymer.

TABLE 2
(1)
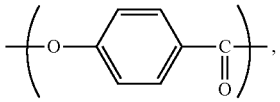
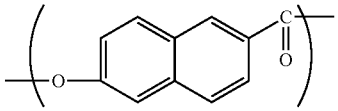
(2)
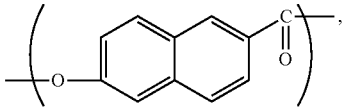
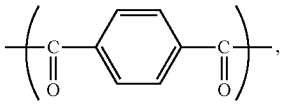
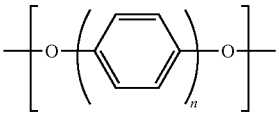
(3)
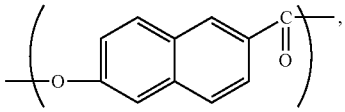
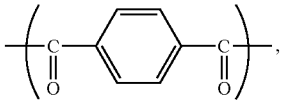
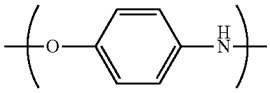
(4)
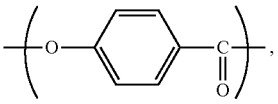
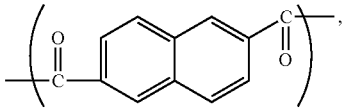
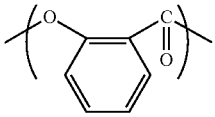
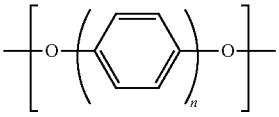
TABLE 2-continued
(5)
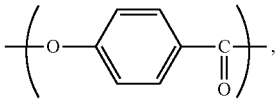
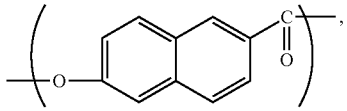
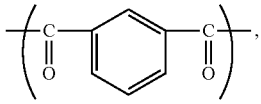
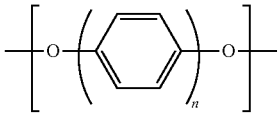
(6)
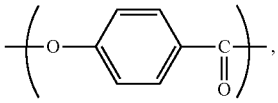
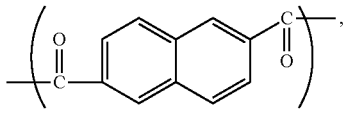
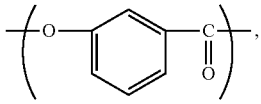
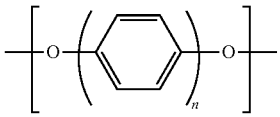
(7)
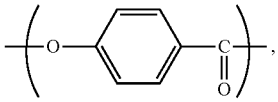
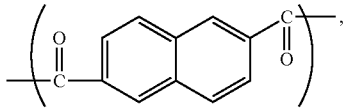
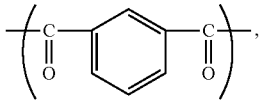
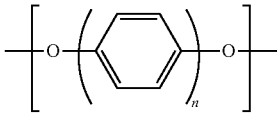

TABLE 2-continued
(8)
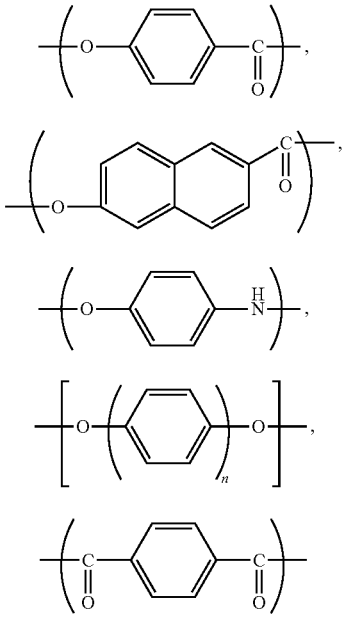
TABLE 3
(9)
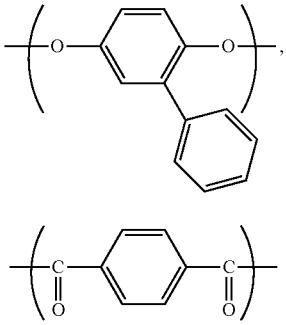
(10)
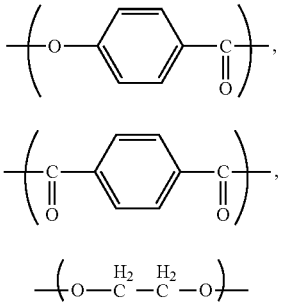
TABLE 3-continued
(11)
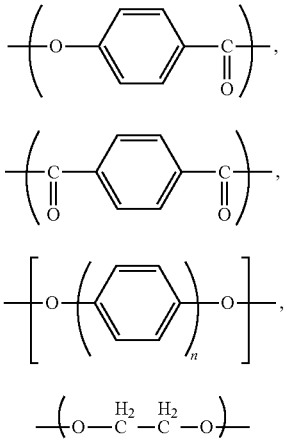
(12)
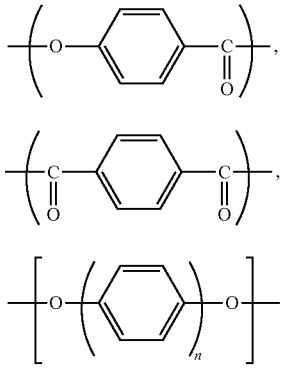
(13)
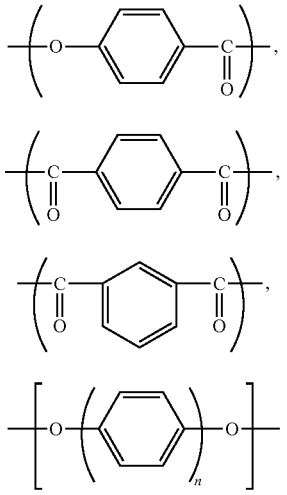

TABLE 3-continued (14)

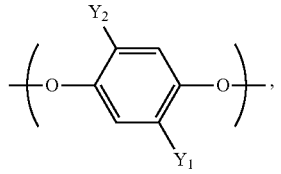

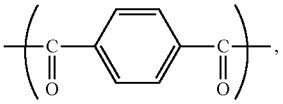

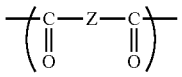

(15)

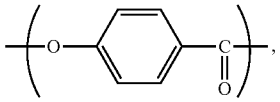

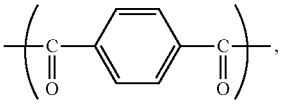

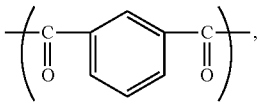

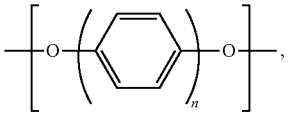

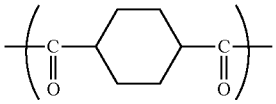

TABLE 4

(16)

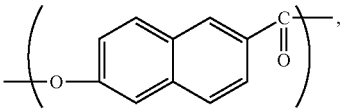

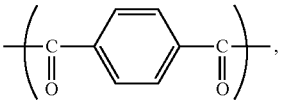

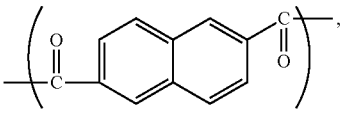

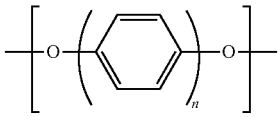

TABLE 4-continued (17)

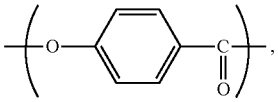

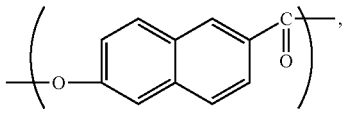

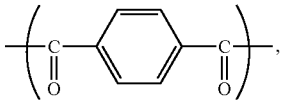

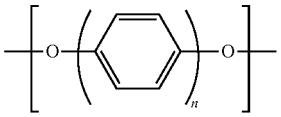

(18)

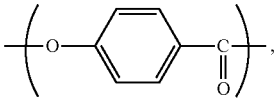

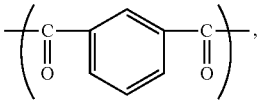

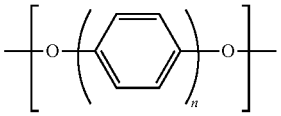

In the structural units of Table 2, Table 3 and Table 4, n is an integer of one or two, and each of the structural units of n=1 and n=2 may either be alone or combined with another. Y1 and Y2 may be, independently, a hydrogen atom, a halogen atom (for example, a fluorine atom, a chlorine atom, a bromine atom or an iodine atom), an alkyl group (for example, alkyl groups having carbon atomic numbers 1 to 4 such as a methyl group, an ethyl group, an isopropyl group, or a t-butyl group), an alkoxy group (for example, a methoxy group, an ethoxy group, an isopropoxy group or a n-butoxy group) an aryl group (for example, a phenyl group, and a naphthyl group), an aralkyl group (for example, a benzyl group (a phenylmethyl group) or a phenethyl group (a phenylethyl group)), an aryloxy group (for example, a phenoxyl group), or an aralkyloxy group (for example, a benzyloxy group). Among these options, a hydrogen atom, a chlorine atom, a bromine atom, or a methyl group is preferable.

Further, Z may be a substituent represented by the following formula.

[Formula 1]

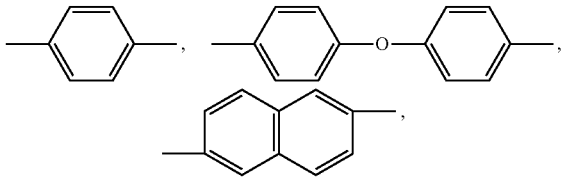

-continued

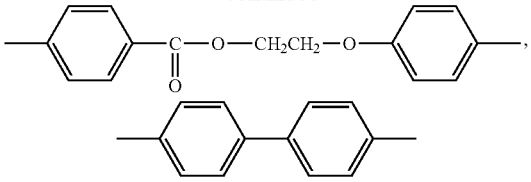

The liquid crystalline polyester would preferably be a combination having a naphthalene skeleton as a structural unit. The liquid crystalline polyester more preferably include a structural unit (A) derived from hydroxybenzoic acid and a structural unit (B) derived from hydroxynaphthoic acid. For example, the structural unit (A) may include formula (A) below, and the structural unit (B) may include formula (B) below. In order to improve melt moldability, the ratio of structural unit (A) to structural unit (B) is preferably in the range from 9/1 to 1/1, more preferably from 7/1 to 1/1, and still more preferably from 5/1 to 1/1.

[Formula 2]

(A)

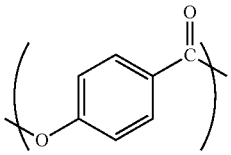

[Formula 3]

(B)

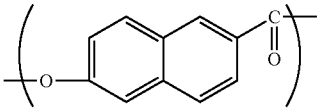

The total of the structural unit (A) and the structural unit (B) may be, for example, 65 mol percent or more of all of the structural units, more preferably would be 70 mol percent or more, and still more preferably would be 80 mol percent or more. In the polymer, a liquid crystalline polyester in which the structural unit (B) is from 4 to 45 mol percent is preferable.

The melting point (defined below) of the suitable liquid-crystal polymer in the present invention is preferably within a range from 250 to 360° C., more preferably from 260 to 320° C. The melting point means the main absorption peak temperature that is observed, upon being measured with a differential scanning calorimeter ("DSC") ("TA 3000" manufactured by Mettler Co., Ltd.) in accordance with the JIS K 7121 test method. Specifically, a sample (10 mg to 20 mg) is taken in the DSC apparatus, and is enclosed in an aluminum pan. Then, 100 cc per min of nitrogen is supplied as a carrier gas, and the endothermic peak is measured when the temperature is raised by 20° C. per minute. Depending on the type of polymer, if a clear peak does not appear at 1st run in the DSC measurement, the temperature should be raised to 50° C. higher than the expected flow temperature at a rate of temperature rising by 50° C. per minute, the polymer should be completely melted at that temperature for three minutes and then cooled to 50° C. at a rate of temperature falling by 80° C. per minute, and thereafter, the endothermic peak should be measured at a rate of temperature rising by 20° C. per minute.

In addition, thermoplastic polymers such as polyethylene terephthalate, modified polyethylene terephthalate, polyolefin, polycarbonate, polyamide, polyphenylene sulfide, polyether ether ketone, and fluorocarbon resin may be added to the liquid crystalline polyester above to an extent that does not impede the effects of the present invention. Furthermore, the liquid crystalline polyester may also contain: inorganic materials such as titanium oxide, kaolin, silica, barium oxide; colorants such as carbon black, dyes and pigments; and additives such as antioxidants, ultraviolet ray absorbents, and light stabilizers.

As the liquid crystalline polyester fiber of the present invention, the fibers obtained by melt spinning can be used. Melt spinning can be carried out by well-known or commonly-used methods. For example, the liquid crystalline polyester fiber can be obtained by forming a fiber from melting resin collected from an extruder and discharging it from a nozzle at a predetermined spinning temperature.

The single-fiber fineness of the liquid crystalline polyester fiber of the present invention is, but not particularly limited to, preferably be 0.5 dtex or more and 50 dtex or less, more preferably 1 dtex or more and 15 dtex or less, and still more preferably 1.5 dtex or more and 10 dtex or less. There are no particular limitations to the total fineness of the multifilament fiber above, but it would preferably be 10 dtex or more and 50000 dtex or less, more preferably 15 dtex or more and 30000 dtex or less, and still more preferably 25 dtex or more and 10000 dtex or less. Furthermore, the multifilament can be aligned and used as a tow. The tow thickness would preferably be 0.1 mm or more and 10 mm or less, more preferably 0.2 mm or more and 5 mm or less, and still more preferably 0.3 mm or more and 3 mm or less.

By controlling single fibers from contacting each other by attaching a water-soluble salt to the raw spun yarn before the heat treatment, inter-fiber fusion in the liquid crystalline polyester fiber of the present invention can be substantially prevented. Examples of a method for attaching a water-soluble salt include a method of directly attaching the water-soluble salt to a raw spun yarn, a method of attaching the water-soluble salt as an aqueous solution and precipitating a solid, or a method of attaching the water-soluble salt together with a water-soluble binder or an adhesive to the fiber. With respect to the total weight of the spun yarn, the amount of the water-soluble salt attached is preferably be 0.1 percent by weight or more, more preferably 0.3 percent by weight or more, still more preferably 0.5 percent by weight or more; and preferably is 5 percent by weight or less, more preferably 4 percent by weight or less, still more preferably 3 percent by weight or less. If the attached amount is too small, the effect of preventing fusion is decreased. If the attached amount is too large, the water-soluble salt covers the surface of the fiber and it becomes difficult for the heat to be transmitted within the fiber during the heat treatment. Neither is preferable.

The method of applying heat treatment may be a well-known method, for example, the atmospheric heating method or the direct contact heating. As the atmosphere, either air or an inert gas (for example, nitrogen or argon) may be used. As long as the heat treatment method does not impede the effects of the present invention, either the batch method or the roll-to-roll method may be adopted. In addition, if the melting point of the liquid crystalline polyester fiber is set to Tm, the heat treatment is carried out in a temperature range from Tm-80° C. and Tm. Since the melting point of the fibers increases with the heat treatment, it is preferable to apply heat to the fibers in a gradually increasing temperature pattern.

The method for removing the water-soluble salt after the heat treatment of the fiber is, for example, but not limited to, a method in which the fiber is immersed in a polar solvent such as water, a method in which the fiber is irradiated with ultrasonic waves in a polar solvent such as water, and a method in which the fiber is vibrated in a polar solvent such as water. The solvent for removing the water-soluble salt is preferably water considering the chemical influence on the fiber as well as from the point of view of operator safety and environmental risk.

Since the fiber of the present invention do not have fused single fibers, the impregnation properties of the matrix resin are excellent. Since the fiber of the present invention has few residues of anti-fusion age, it is excellent in post-processability and physical properties after being processed. Therefore, it can be suitably used for various kinds of composite materials.

Examples of the composite material of the present invention include a composite material in which the fibers of the present invention are impregnated with a matrix resin in the form of a woven fabric or a sheet, or a composite material in which the fibers of the present invention are laminated in a woven fabric or a sheet form and impregnated with a matrix resin.

EXAMPLES

Using Autograph AGS-100b manufactured by Shimadzu Corporation, the tensile strength (cN/dtex) was measured in accordance with JIS L 1013 by setting the thread length at 200 mm, the initial load at 0.09 cN/dtex, and the tensile speed at 100 mm/min. The average value over 6 times was calculated per sample.

The attachment rate (percent by weight) of the anti-fusion agent was calculated by Formula (1) below, which represents an increase in weight due to the attachment process of the anti-fusion agent. The samples before and after the attachment process were each dried at 100° C. for 10 minutes and the weight of each sample with the same length was measured. The length of the samples was set in a range in which the weight was more than 0.5 g. The values are average values of ten measurements for randomly collected samples before and after the attachment process of the anti-fusion agent.

[Equation 1]

$$\text{Anti-fusion agent attachment rate(percent by weight)} = 100\times\{(\text{weight of sample after process})-(\text{weight of material before process})\}/(\text{weight of sample after process}) \quad (1)$$

The degree of fusion (0 was calculated by dispersing a sample obtained by cutting a heat-treated fiber bundle to a length of 20 mm by using Bransonic 220 manufactured by Yamato Scientific Co., Ltd. in water for 20 minutes, determining the total number of single yarns dispersed in water (n), and calculating the relationship with the number (N) of single yarns before heat treatment based on Formula (2) below. The value is an average value of ten measurements of samples randomly collected after the heat treatment.

[Equation 2]

$$f=N/n \quad (2)$$

The ash content was calculated from the ratio of the weight after ashing compared against the weight before ashing, which is obtained by ashing two grams of fiber at 625° C. in accordance with JIS K 7052 (firing method) for three hours.

The process passage capability was evaluated from the number of single-yarn breakage and the number of fibrils remaining after the sample had passed through the roller guide. In other words, after having the sample pass through a hard chromium-textured bearing roller guide having a diameter of 40 mm at a running speed of 100 m/min, with a tension of 40 g after passing through the guide and a contact angle of 90 degrees, a length of 10 cm×10 filaments (total 1 meter) was collected per sample, and the number of single-yarn breakage (as defined below) and the number of fibrils remaining were counted and measured with the eye using a loupe and an optical microscope.

"Single-yarn breakage" refers to a section where the end of a single fiber can be visually confirmed except the end of the sample. In addition, "fibrils" refer to sections where fuzzing from friction can be observed on the surface and, independent of other sections, fibrous peeling can be observed.

Regarding the evaluation of process passage capability, "A" means that there was one or fewer single-yarn breakage or fibril within 1 m, "B" means that there were two or more and ten or fewer single-yarn breakages or fibrils, and "C" means that there were 11 or more single-yarn breakages or fibrils.

Example 1

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a two percent by weight aqueous solution of potassium iodide (trade name: special grade reagent potassium iodide manufactured by Wako Pure Chemical Industries, Ltd.) and dried at 100° C. for ten minutes. At this time, the amount of the water-soluble salt attached was two percent by weight of the total weight of the spinning yarn. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for 3 minutes, the potassium iodide that was attached to the fiber was removed and product oil was applied to obtain the fiber product.

As shown in Table 5, the ash content of the fiber was 0.06 percent by weight, the degree of fusion (f) was 1.07, the tensile strength was 24.5 cN/dtex and the residual amount of the anti-fusion agent was small, resulting in no fusion between the fibers. It can also be found that the fiber strength was excellent.

Further, since the ash content is 0.3 percent by weight or less, the residual amount of the anti-fusion agent on the fiber surface is small; therefore, as shown in Table 5, it can be found that there was a small number of single-yarn breakages and fibrils and the process passage capability was excellent.

Example 2

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a two percent by weight aqueous solution of sodium chloride (trade name: special grade reagent sodium chloride manufactured by Wako Pure Chemical Industries, Ltd.) and dried at 100° C. for ten minutes. At this time, the amount of the water-soluble salt attached was two percent by weight of the total weight of the spinning yarn. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for 3 minutes, the sodium chloride that was attached to the fiber was removed and product oil was applied to obtain the fiber product.

As shown in Table 5, the ash content of the fiber was 0.07 percent by weight, the degree of fusion (f) was 1.09, the tensile strength was 23.9 cN/dtex and the residual amount of the anti-fusion agent was small, resulting in no fusion between the fibers. It can also be found that the fiber strength was excellent.

Further, since the ash content is 0.3 percent by weight or less, the residual amount of the anti-fusion agent on the fiber surface is small; therefore, as shown in Table 5, it can be found that there was a small number of single-yarn breakages and fibrils and the process passage capability was excellent.

Example 3

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a two percent by weight aqueous solution of potassium chloride (trade name: special grade reagent potassium chloride manufactured by Wako Pure Chemical Industries, Ltd.) and dried at 100° C. for ten minutes. At this time, the amount of the water-soluble salt attached was two percent by weight of the total weight of the spinning yarn. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for 3 minutes, the potassium chloride that was attached to the fiber was removed and product oil was applied to obtain the fiber product.

As shown in Table 5, the ash content of the fiber was 0.09 percent by weight, the degree of fusion (f) was 1.11, the tensile strength was 23.3 cN/dtex and the residual amount of the anti-fusion agent was small, resulting in no fusion between the fibers. It can also be found that the fiber strength was excellent.

Further, since the ash content is 0.3 percent by weight or less, the residual amount of the anti-fusion agent on the fiber surface is small; therefore, as shown in Table 5, it can be found that there was a small number of single-yarn breakages and fibrils and the process passage capability was excellent.

Example 4

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a two percent by weight aqueous solution of sodium iodide (trade name: special grade reagent sodium iodide manufactured by Wako Pure Chemical Industries, Ltd.) and dried at 100° C. for ten minutes. At this time, the amount of the water-soluble salt attached was two percent by weight of the total weight of the spinning yarn. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for three minutes, the sodium iodide that was attached to the fiber was removed and product oil was applied to obtain the fiber product.

As shown in Table 5, the ash content of the fiber was 0.07 percent by weight, the degree of fusion (f) was 1.09, the tensile strength was 23.2 cN/dtex and the residual amount of the anti-fusion agent was small, resulting in no fusion between the fibers. It can also be found that the fiber strength was excellent.

Further, since the ash content is 0.3 percent by weight or less, the residual amount of the anti-fusion agent on the fiber surface is small; therefore, as shown in Table 5, it can be found that there was a small number of single-yarn breakages and fibrils and the process passage capability was excellent.

Example 5

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a 0.05 percent by weight aqueous solution of potassium iodide (trade name: special grade reagent potassium iodide manufactured by Wako Pure Chemical Industries, Ltd.) and dried at 100° C. for ten minutes. At this time, the amount of the water-soluble salt attached was 0.05 percent by weight of the total weight of the spinning yarn. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for 3 minutes, the potassium iodide that was attached to the fiber was removed and product oil was applied to obtain the fiber product.

As shown in Table 5, the ash content of the fiber was 0.04 percent by weight, the degree of fusion (f) was 2.91, the tensile strength was 23.1 cN/dtex and the residual amount of the anti-fusion agent was small, resulting in no fusion between the fibers. It can also be found that the fiber strength was excellent.

In contrast to examples 1 to 4 described above, since a sufficient amount of the anti-fusion agent was not adhered, the fusion between the fibers was slightly larger than that of examples 1 to 4.

Example 6

A liquid crystalline polyester fiber multifilament (Vectran NT manufactured by Kuraray Co., Ltd.) of three hundred filaments that have a total fineness of 1670 dtex was used as the raw spun yarn.

The fiber was immersed in a 0.25 percent by weight aqueous a solution of potassium iodide (trade name: special grade reagent potassium iodide manufactured by Wako Pure Chemical Industries, Ltd.) and dried at 100° C. for ten minutes. At this time, the amount of the water-soluble salt attached was 0.25 percent by weight of the total weight of the spinning yarn. In a nitrogen atmosphere, the temperature was gradually increased in a range between the room temperature and 300° C., and the reaction was carried out for 16 hours. Thereafter, a product oil agent was applied to obtain a fiber product.

As shown in Table 5, the ash content of the fiber was 0.25 percent by weight, the degree of fusion (f) was 1.80, the tensile strength was 24.0 cN/dtex and the residual amount of the anti-fusion agent was small, resulting in no fusion between the fibers. It can also be found that the fiber strength was excellent.

Further, since the ash content is 0.3 percent by weight or less, the residual amount of the anti-fusion agent on the fiber surface is small; as shown in Table 5, it can found that the numbers of single-yarn breakages and fibrils were small and the process passage capability was excellent.

Comparative Example 1

A liquid crystalline polyester fiber multifilament (Vectran NT manufactured by Kuraray Co., Ltd.) of three hundred filaments that have a total fineness of 1670 dtex was used as the raw spun yarn.

The temperature of the fiber was gradually increased in a range between the room temperature and 300° C. in a nitrogen atmosphere, and the reaction was carried out for 16 hours. Thereafter, a product oil agent was applied to obtain a fiber product.

As shown in Table 5, the ash content of the fiber was 0.04 percent by weight, the tensile strength was 23.2 cN/dtex; however, while there was excellent process passage capability, the degree of fusion (f) was 5.88 and there was a large amount of fusion between the fibers. In Comparative Example 1, it seems that a fiber without fusion could not be obtained since the single fibers fused because the anti-fusion agent was not applied.

Comparative Example 2

A liquid crystalline polyester fiber multifilament (Vectran NT manufactured by Kuraray Co., Ltd.) of three hundred filaments that have a total fineness of 1670 dtex was used as the raw spun yarn.

0.5 percent by weight of synthetic mica particles (trade name: Somasif ME-100 manufactured by Corp Chemical Co., Ltd.), a type of inorganic particle, were attached to the fiber, and then, the fiber was dried at 100° C. for ten minutes. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for three minutes, product oil was applied and the fiber product was obtained.

As shown in Table 5, the degree of fusion (f) is 1.13. While there is no fusion between the fibers, the ash content of the fiber was 0.35 percent by weight. Since there was a larger amount of inorganic particles that remained after washing, a higher number of defects were found in the fiber due to the inorganic particles. Also, as compared with examples 1-6, it can be seen that the tensile strength decreased (decreased to 21 cN/dtex).

Further, since a large amount of inorganic particles is left, as shown in Table 5, it can be found that there are a large number of single-yarn breakages and fibrils, resulting in lower process passage capability.

Comparative Example 3

A liquid crystalline polyester fiber multifilament (Vectran NT manufactured by Kuraray Co., Ltd.) of three hundred filaments that have a total fineness of 1670 dtex was used as the raw spun yarn.

Two percent by weight of barium sulfate (trade name: BARICLEAR BF-20FW manufactured by SAKAI CHEMICAL INDUSTRY CO., LTD.) was attached to the fiber, and then, the fiber was dried at 100° C. for ten minutes. In a nitrogen atmosphere, the temperature was gradually increased in a range between the room temperature and 300° C., and the reaction was carried out for 16 hours. Then, upon performing ultrasonic cleaning (using Ultrasonic Cleaner ASU-20D manufactured by AS ONE Corporation) carried out in water at 50° C. for three minutes, product oil was applied, and the fiber product was obtained.

As shown in Table 5, the degree of fusion (f) is 1.18. While there is no fusion between the fibers, the ash content of the fiber was 1.24 percent by weight. Since there was a larger amount of barium sulfate remaining after washing, a higher number of defects were found in the fiber due to the inorganic particles. Also, as compared with examples 1-6, it can be seen that the tensile strength decreased (decreased to 22.8 cN/dtex).

Further, since a large amount of barium sulfate is left, as shown in Table 5, it can be found that there are a large number of single-yarn breakages and fibrils, resulting in lower process passage capability.

TABLE 5

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Liquid Crystalline Polyester Fiber | "Vectran NT" Manufactured by Kuraray Co., Ltd. | | | | | | | | |
| Total Fineness (dtex) | 1670 | 1670 | 1670 | 1670 | 1670 | 1670 | 1670 | 1670 | 1670 |
| Number of Filaments | 300 | 300 | 300 | 300 | 300 | 300 | 300 | 300 | 300 |
| Anti-Fusion Agent | Potassium Iodide | Sodium Chloride | Potassium Chloride | Sodium Iodide | Potassium Iodide | Potassium Iodide | None | Synthetic Mica | Barium Sulfate |
| Anti-Fusion Agent Attachment Rate (percent by weight) | 2 | 2 | 2 | 2 | 0.05 | 0.25 | — | 0.5 | 2 |
| Ash Content (percent by weight) | 0.06 | 0.07 | 0.09 | 0.07 | 0.04 | 0.25 | 0.04 | 0.35 | 1.24 |

TABLE 5-continued

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Degree of Fusion f | 1.07 | 1.09 | 1.11 | 1.09 | 2.91 | 1.80 | 5.88 | 1.13 | 1.18 |
| Tensile Strength (cN/dtex) | 24.5 | 23.9 | 23.3 | 23.2 | 23.1 | 24.0 | 23.2 | 21.1 | 22.8 |
| Process Passage Capability | A | A | A | A | A | B | A | C | C |

INDUSTRIAL APPLICABILITY

The fiber of the present invention can be suitably used as a fiber in composite members such as a laminate or as a fiber to be plated with, e.g., an electric wire of an organic material.

The invention claimed is:

1. A method for manufacturing a liquid crystalline polyester fiber, the method comprising:

attaching a water-soluble alkali metal halide salt to a raw spun yarn of the liquid crystalline polyester fiber before performing a heat treatment, wherein the liquid crystalline polyester fiber has an ash content of 0.1% by weight or less and a degree of fusion (f) of 1.5 or less, and an amount of the water-soluble alkali metal halide salt attached to the raw spun yarn is 0.1% by weight or more and 4% by weight or less with respect to a total weight of the raw spun yarn.

2. The method of claim 1, further comprising:

washing the water-soluble alkali metal halide salt after the heat treatment.

3. The method of claim 1, wherein the amount of the water-soluble alkali metal halide salt attached to the raw spun yarn is 0.1% by weight or more and 3% by weight or less with respect to the total weight of the raw spun yarn.

4. The method of claim 1, wherein the water-soluble alkali metal halide salt comprises at least one selected from the group consisting of lithium chloride, sodium chloride, potassium chloride, lithium bromide, sodium bromide, potassium bromide, lithium iodide, sodium iodide, and potassium iodide.

5. A method for manufacturing a composite material, comprising:

manufacturing a liquid crystalline polyester fiber by the method of claim 1; and impregnating a matrix resin into the liquid crystalline polyester fiber.

6. The method of claim 1, wherein the water-soluble alkali metal salt comprises at least one selected from the group consisting of sodium iodide, potassium iodide, sodium chloride, and potassium chloride.

7. The method of claim 3, wherein the water-soluble alkali metal salt comprises at least one selected from the group consisting of sodium iodide, potassium iodide, sodium chloride, and potassium chloride.

8. A method for manufacturing a liquid crystalline polyester fiber, the method comprising:

attaching an aqueous solution of a water-soluble alkali metal halide salt to a raw spun yarn of the liquid crystalline polyester fiber;

drying the raw spun yarn to precipitate the solid alkali metal halide salt; and subsequently performing a heat treatment, wherein the liquid crystalline polyester fiber has an ash content of 0.1% by weight or less and a degree of fusion (f) of 1.5 or less, and an amount of the water-soluble alkali metal halide salt attached to the raw spun yarn is 0.1% by weight or more and 4% by weight or less with respect to a total weight of the raw spun yarn.

9. The method of claim 8, further comprising:

washing the water-soluble alkali metal halide salt after the heat treatment.

10. The method of claim 1, wherein the liquid crystalline polyester fiber has a tensile strength of 18 cN/dtex or more.

* * * * *